US010663906B2

(12) United States Patent
Suzuki et al.

(10) Patent No.: US 10,663,906 B2
(45) Date of Patent: May 26, 2020

(54) PRINTER AND COMPUTER READABLE STORAGE DEVICE

(71) Applicant: BROTHER KOGYO KABUSHIKI KAISHA, Nagoya-shi, Aichi-ken (JP)

(72) Inventors: Takashi Suzuki, Nagoya (JP); Tetsuya Okano, Anjo (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 159 days.

(21) Appl. No.: 15/456,940

(22) Filed: Mar. 13, 2017

(65) Prior Publication Data

US 2017/0269535 A1 Sep. 21, 2017

(30) Foreign Application Priority Data

Mar. 15, 2016 (JP) ..... 2016-050481

(51) Int. Cl.
*B65H 7/00* (2006.01)
*G03G 15/00* (2006.01)
(Continued)

(52) U.S. Cl.
CPC ..... *G03G 15/70* (2013.01); *G03G 15/6529* (2013.01); *B65H 7/00* (2013.01); *B65H 7/20* (2013.01); *B65H 43/00* (2013.01)

(58) Field of Classification Search
None
See application file for complete search history.

(56) References Cited

U.S. PATENT DOCUMENTS 4,231,567 A * 11/1980 Ziehm ..... B65H 7/06 192/127
4,412,735 A * 11/1983 Tsukata ..... G03G 15/00 399/81
(Continued)

FOREIGN PATENT DOCUMENTS

JP 1-232078 A 9/1989
JP 5-155081 A 6/1993
(Continued)

OTHER PUBLICATIONS

Notice of Reasons for Refusal issued in counterpart Japanese Patent Application No. 2016-050481, dated Nov. 26, 2019.

*Primary Examiner* — Jill E Culler
(74) *Attorney, Agent, or Firm* — Merchant & Gould P.C.

(57) ABSTRACT

A printer includes a casing, a print mechanism disposed inside the casing, and a paper tray. A conveying route extends from the tray to the print mechanism, with a first roller disposed adjacent the tray to feed a sheet from the tray to the conveying route. A second roller is disposed in the conveying route and conveys the sheet fed by the first roller to the print mechanism. A driving source provides a driving source to the first roller and the second roller. A controller is configured to, in response to a printing request, apply the driving force from the driving source to the first and second rollers such that the first and second rollers rotate. In response to a magnitude of a load of the driving source, the controller applies the driving force to the second roller such that the second roller rotates, and the controller does not apply the driving source to the first roller such that the first roller does not rotate.

27 Claims, 7 Drawing Sheets

(51) Int. Cl.
*B65H 7/20* (2006.01)
*B65H 43/00* (2006.01)

(56) References Cited

U.S. PATENT DOCUMENTS

| | | | | |
|---|---|---|---|---|
| 8,744,280 | B1 * | 6/2014 | Poppenga | G03G 15/6558 271/258.01 |
| 2009/0310983 | A1 * | 12/2009 | Shoji | G03G 15/6529 399/20 |
| 2011/0064427 | A1 * | 3/2011 | Yoshida | B65H 43/04 399/21 |
| 2014/0219668 | A1 * | 8/2014 | Mine | G03G 15/5004 399/21 |
| 2015/0080201 | A1 * | 3/2015 | Izumichi | B65H 45/18 493/442 |
| 2015/0277334 | A1 * | 10/2015 | Matsuo | G03G 15/70 399/21 |
| 2015/0309465 | A1 * | 10/2015 | Matsumoto | G03G 15/70 399/21 |
| 2016/0060057 | A1 * | 3/2016 | Nobuta | H02P 29/032 74/405 |

FOREIGN PATENT DOCUMENTS

| | | | |
|---|---|---|---|
| JP | 7-256958 | A | 10/1995 |
| JP | 11-59969 | A | 3/1999 |
| JP | 2003-312893 | A | 11/2003 |
| JP | 2012-17152 | A | 1/2012 |

* cited by examiner

PRINTER AND COMPUTER READABLE STORAGE DEVICE

CROSS-REFERENCE TO RELATED APPLICATION

This application claims priority from Japanese Patent Application No. 2016-050481 filed on Mar. 15, 2016, the content of which is incorporated herein by reference in its entirety.

FIELD OF DISCLOSURE

The disclosure relates to a printer and computer readable storage device.

BACKGROUND

A known printer decides that, if a predetermined time elapses after a current flowing in a driving motor that feeds sheets has exceeded a reference value, there is a jam (more specifically, a paper jam).

SUMMARY

In accordance with aspects of the present disclosure, a printer includes a casing, a print mechanism disposed inside the casing, and a tray configured to support a sheet stack including one or more sheets. A conveying route extends from the tray to the print mechanism, with a first roller disposed adjacent the tray to feed a sheet from the tray to the conveying route. A second roller is disposed in the conveying route and conveys the sheet fed by the first roller to the print mechanism. A driving source provides a driving source to the first roller and the second roller. A controller is configured to, in response to a printing request, apply the driving force from the driving source to the first and second rollers such that the first and second rollers rotate. In response to a magnitude of a load of the driving source, the controller applies the driving force to the second roller such that the second roller rotates, and the controller does not apply the driving source to the first roller such that the first roller does not rotate.

DETAILED DESCRIPTION

In an image forming apparatus such as a printer, if a paper jam is detected as early as possible in continuous sheet feeding, the number of jammed sheets can be reduced. This can be expected to suppress the jam from becoming worse. Detection of a small degree jam is effective in early detection of a jam. The larger a jam is, the more a current tends to flow in the driving motor. Therefore, a possible solution to detecting a small degree jam is to reduce the above reference value. If, however, the reference value is reduced, an overcurrent due to a factor other than a jam is also detected. This may cause a jam to be incorrectly detected. If the operation of the printer is stopped in spite of incorrect detection, the throughput may be lowered.

Outline of the Printer

The laser printer (simply referred to below as the printer) 1 in this application will be described with reference to FIG. 1. The directions in the description below are defined with respect to the user who uses the printer 1. Specifically, in FIG. 1, the left side is "front", the right side is "back", the top side is "up", and the bottom side is "down".

Figure 1:
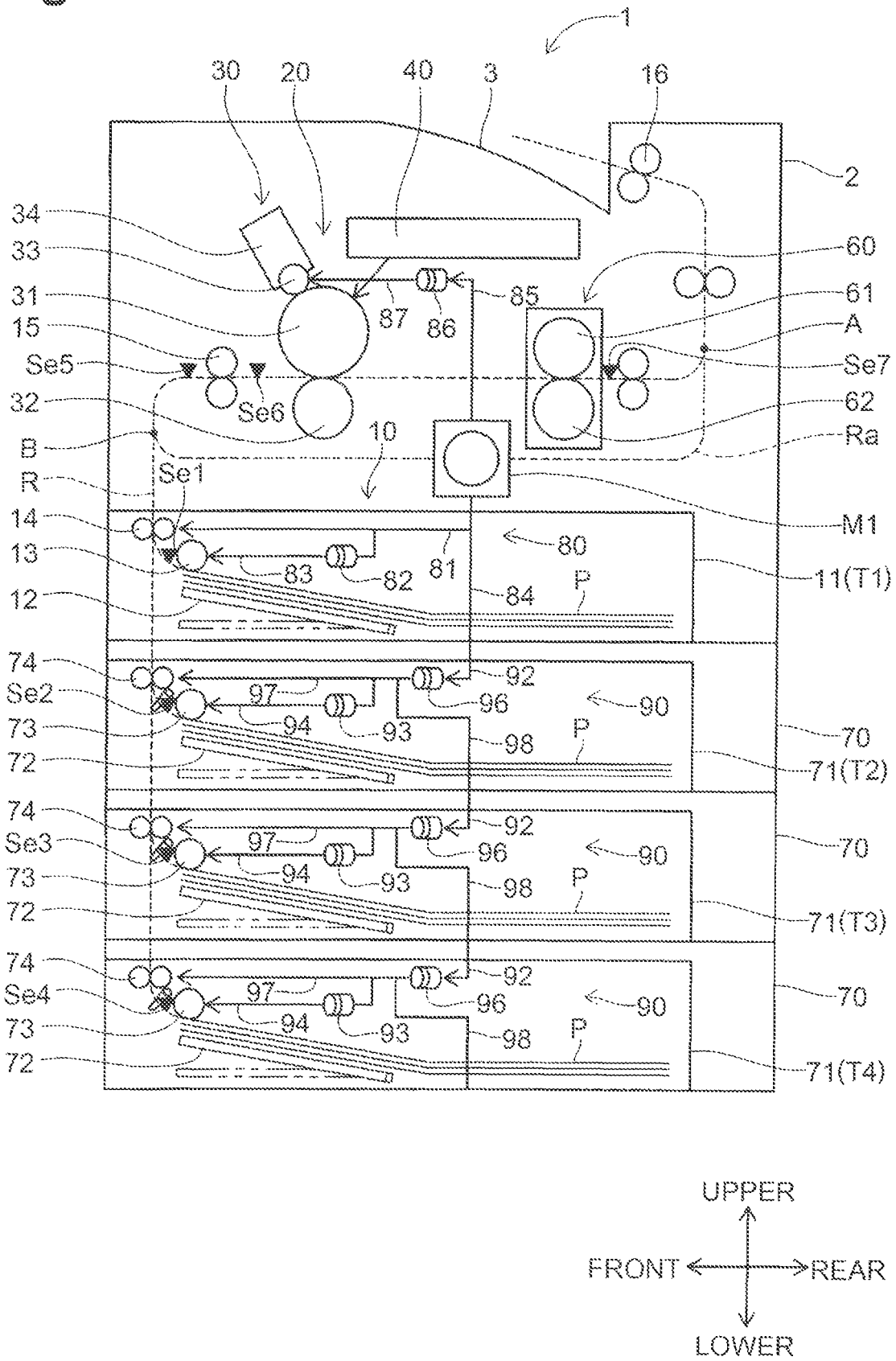
FIG. 1 is a cross-sectional view illustrating the general structure of a printer in an embodiment.

As illustrated in FIG. 1, the printer 1 includes a main device 2, shaped substantially like a box, and three optional sheet feed units 70. The main device 2 includes a sheet feed unit 10, a print mechanism or image forming unit 20, and a motor M1. A discharge tray 3, on which discharged sheets P are stacked, is formed on the upper surface of the main device 2. The discharge tray 3 is inclined upwardly at an oblique angle from the back side toward the front side.

The sheet feed unit 10 includes a feed tray 11, in which sheets P are stacked, a main body pressing plate 12, a supply roller 13, conveying rollers 14, and the like. The main body pressing plate 12, the rotational center of which is at the back end of the main body pressing plate 12, can be rotated from a standby position indicated by dash-dot-dot lines in FIG. 1 to a raised position indicated by solid lines. A sheet P is pressed against the supply roller 13 by the main body pressing plate 12 raised to the raised position. When the supply roller 13 is rotated while being in contact with the sheet P, the sheet P is fed out and conveyed to the image forming unit 20 through the conveying rollers 14, conveying rollers 15, and the like along a conveying route R. The conveying rollers 14 are disposed in the vicinity of the supply roller 13 at its downstream side in the conveying direction. The conveying rollers 15 are disposed upstream of a photosensitive drum 31 in the image forming unit 20 in the conveying direction. Conveying rollers 16 are disposed in the vicinity of the discharge tray 3.

The image forming unit 20 is disposed substantially at the center of the main device 2 and on the sheet feed unit 10. The image forming unit 20 includes a process cartridge 30, an exposure device 40, a fixing unit 60, and the like.

The process cartridge 30 includes the photosensitive drum 31, a transfer roller 32, a developing roller 33, a toner storage 34, a charger (not illustrated), a layer thickness restricting blade (not illustrated), and the like.

The exposure device 40, which is disposed above the photosensitive drum 31, includes a laser light source (not illustrated), a polygon mirror (not illustrated), and the like. A laser beam emitted from the laser light source is deflected by the polygon mirror and illuminates the surface of the photosensitive drum 31.

The fixing unit 60 is disposed behind the main device 2. The fixing unit 60 includes a heating roller 61, a pressurizing roller 62, and the like.

The motor M1 is a driving source that drives the supply roller 13, conveying rollers 14, and the like. The driving force of the motor M1 is transmitted through a driving force transmitting mechanism 80 to the supply roller 13 and conveying rollers 14. The driving force transmitting mechanism 80 includes a first transmitting portion 81, electromagnetic clutches 82 and 86, a second transmitting portion 83, a third transmitting portion 84, a fourth transmitting portion 85, a fifth transmitting portion 87, and the like. The first transmitting portion 81 transmits the driving force of the motor M1 to the conveying rollers 14. The first transmitting portion 81 is connected to the input side of the electromagnetic clutch 82, and the second transmitting portion 83 is connected to the output side of the electromagnetic clutch 82. The electromagnetic clutch 82 is switched between a transmission state in which the electromagnetic clutch 82 can transmit the driving force to the supply roller 13 and a disconnected state in which the electromagnetic clutch 82 ceases the transmission of the driving force. The third transmitting portion 84, which branches from the first transmitting portion 81, is structured so that the third transmitting portion 84 can transmit the driving force to the optional sheet feed unit 70 connected behind the third transmitting portion 84. The fifth transmitting portion 87 transmits the driving force of the motor M1 through the electromagnetic clutch 86 to the developing roller 33. The fourth transmitting portion 85 is connected to the input side of the electromagnetic clutch 86, and the fifth transmitting portion 87 is connected to the output side of the electromagnetic clutch 86. The electromagnetic clutch 86 is switched between a transmission state in which the electromagnetic clutch 86 can transmit the driving force to the fifth transmitting portion 87 and a disconnected state in which the electromagnetic clutch 86 ceases the transmission of the driving force. The fifth transmitting portion 87 transmits the driving force to the developing roller 33. The developing roller 33 is structured so that it is rotated even if the electromagnetic clutch 86 is in the disconnected state. The rotational speed of the developing roller 33 with the electromagnetic clutch 86 in the disconnected state is lower than the rotational speed of the developing roller 33 with the electromagnetic clutch 86 in the transmission state.

Each of three optional sheet feed units 70 disposed below the main device 2 includes an optional feed tray 71, an optional pressuring plate 72, an optional supply roller 73, and conveying rollers 74. The optional pressuring plate 72, the rotational center of which is at the back end of the optional pressuring plate 72, can be rotated from a standby position indicated by dash-dot-dot lines in FIG. 1 to a raised position indicated by solid lines. A sheet P is pressed against the optional supply roller 73 by the raised optional pressuring plate 72. When the optional supply roller 73 is rotated while being in contact with the sheet P, the sheet P is fed out toward the conveying route R. In the description below, the feed tray 11 will sometimes be referred to as tray T1, and the three optional feed trays 71 will sometimes be referred to as tray T2, tray T3, and tray T4 sequentially from the top. In the description below, the feeding of a sheet P from the tray T1 toward the conveying route R by the supply roller 13 and the feeding of a sheet P from each of the trays T2 to T4 toward the conveying route R by the relevant optional supply roller 73 will be denoted as sheet supply.

The optional sheet feed unit 70 includes a driving force transmitting mechanism 90 in addition to the components described above. The driving force transmitting mechanism 90 includes a first transmitting portion 92, a second transmitting portion 98, a third transmitting portion 97, a fourth transmitting portion 94, and electromagnetic clutches 93 and 96. If the main device 2 is disposed on one optional sheet feed unit 70, its first transmitting portion 92 is connected to the driving force transmitting mechanism 80 in the main device 2. If another optional sheet feed unit 70 is connected on the optional sheet feed unit 70, its first transmitting portion 92 is connected to the second transmitting portion 98 in the other optional sheet feed unit 70. The first transmitting portion 92 is connected to the input side of the electromagnetic clutch 96, and the fourth transmitting portion 94 is connected to the output side of the electromagnetic clutch 96. The electromagnetic clutch 96 is switched between a transmission state in which the electromagnetic clutch 96 can transmit the driving force to the third transmitting portion 97 and a disconnected state in which the electromagnetic clutch 96 ceases the transmission of the driving force. The third transmitting portion 97 transmits the driving force to the conveying rollers 74. The third transmitting portion 97 is connected to the input side of the electromagnetic clutch 93, and the fourth transmitting portion 94 is connected to the output side of the electromagnetic clutch 93. The electromagnetic clutch 93 is switched between a transmission state in which the electromagnetic clutch 93 can transmit the driving force to the optional supply roller 73 and a disconnected state in which the electromagnetic clutch 93 ceases the transmission of the driving force. The second transmitting portion 98, which branches from the third transmitting portion 97, is structured so that the second transmitting portion 98 can transmit the driving force to another optional sheet feed unit 70 connected behind the second transmitting portion 98 through the electromagnetic clutch 96.

The first transmitting portion 81, second transmitting portion 83, third transmitting portion 84, fourth transmitting portion 85, and fifth transmitting portion 87 provided in the main device 2 are each implemented by using, for example, a plurality of gears. The first transmitting portion 92, second transmitting portion 98, third transmitting portion 97, and fourth transmitting portion 94 provided in the optional sheet feed unit 70 are each also implemented by using, for example, a plurality of gears.

Next, the operation of the printer 1 at the time of image forming will be described. Upon receipt of a print job, the printer 1 executes printing processing according to the print job and forms an image on a sheet P. The surface of the photosensitive drum 31 is positively charged uniformly by the charger and is exposed to laser beams emitted from the exposure device 40 according to print data. Thus, an electrostatic latent image is formed on the surface of the photosensitive drum 31. Then, toner is supplied to the electrostatic latent image formed on the surface of the photosensitive drum 31 by the developing roller 33. Thus, the electrostatic latent image on the surface of the photosensitive drum 31 becomes visible and a toner image is supported on the surface of the photosensitive drum 31.

The sheet P is fed out toward the conveying route R from the sheet feed unit 10 or optional sheet feed unit 70 at a certain time. The sheet P fed out toward the conveying route R is supplied to the image forming unit 20 along the conveying route R by the conveying rollers 74, 14, and 15 and the like. The toner image supported on the surface of the photosensitive drum 31 is transferred to the sheet P by the transfer roller 32. The sheet P is then conveyed to the fixing unit 60 along the conveying route R. Toner is thermally fixed to the sheet P, after which the sheet P is conveyed along the conveying route R and discharged to the discharge tray 3 by the conveying rollers 16.

In the printer 1, a re-conveying route Ra is provided so that two-sided printing can be performed. The re-conveying route Ra is a conveying route along which the sheet P that has passed the fixing unit 60 is re-conveyed to the image forming unit 20 so that printing is performed on a second surface, which is the rear surface of the sheet P for which printing has been performed on a first surface, which is one surface of the sheet P. The re-conveying route Ra branches from the conveying route R at a branching point A located downstream of the heating roller 61 and upstream of the conveying rollers 16 in the conveying direction. The re-conveying route Ra starts from the branching point A, passes between the image forming unit 20 and the feed tray 11, and joins the conveying route R at a joining point B located downstream of the conveying rollers 14 on the conveying route R.

Next, the operation of the printer 1 at the time of two-sided printing will be described. After the sheet P has passed along the conveying route R and an image has been formed on the first surface, the sheet P is conveyed to the conveying rollers 16. After the rear edge of sheet P has passed the branching point A, the conveying rollers 16 temporarily stop its rotation with the sheet P sandwiched between them. Then, the rotational direction of the conveying rollers 16 is changed to reverse the conveying direction of the sheet P. The sheet P is conveyed through the branching point A to the re-conveying route Ra. The sheet P is then returned toward the conveying route R through the joining point B on the upstream side on the conveying route R relative to the image forming unit 20. Therefore, the front and back of the sheet P are reversed and an image is formed on the second surface.

Rear-edge sensors Se1 to Se4 are respectively attached to the trays T1 to T4. A pre-registration sensor Se5 is attached upstream of the conveying rollers 15 in the conveying direction. A first post-registration sensor Se6 is attached between the conveying rollers 15 and the photosensitive drum 31. A second post-registration sensor Se7 is attached downstream of the heating roller 61 in the conveying direction. The back-end sensors Se1 to Se4, pre-registration sensor Se5, first post-registration sensor Se6, and second post-registration sensor Se7 each output an ON signal when a sheet P is present and output an OFF signal when a sheet P is not present.

Although not illustrated, a plurality of conveying rollers are disposed on the conveying route R in addition to the conveying rollers 14, 15, 16, and 74. In the description below, conveying rollers that are not illustrated and the conveying rollers 14, 15, 16, and 74 will be collectively referred to as the conveying rollers.

Electrical Structure

Figure 2:
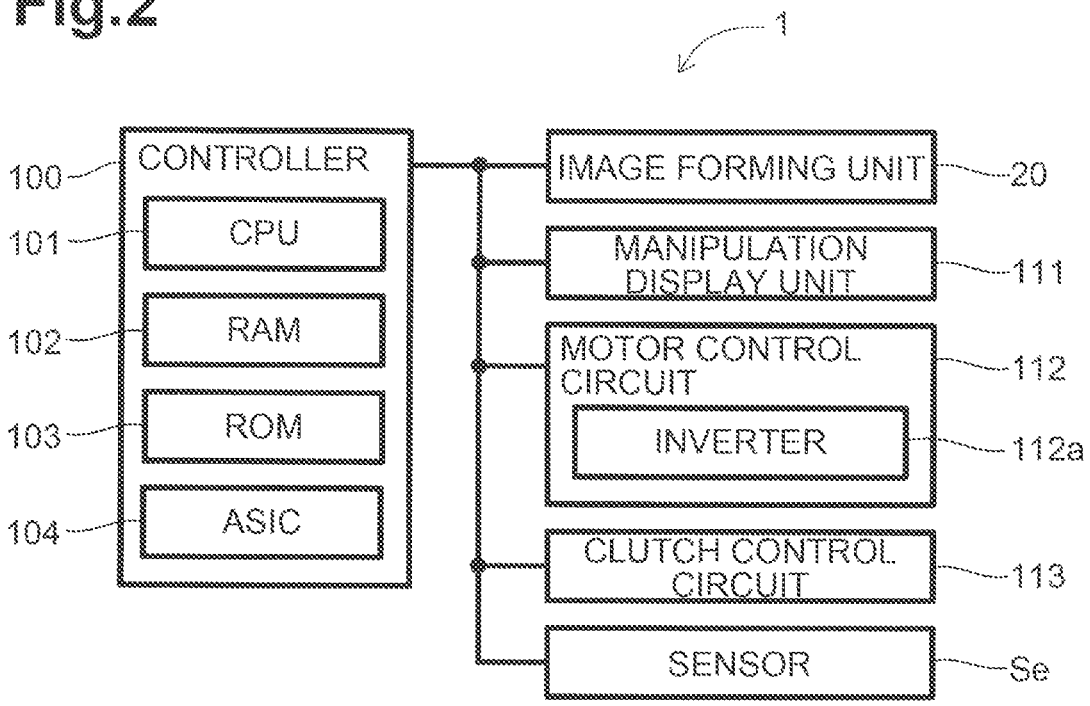
FIG. 2 is a block diagram illustrating the electrical structure of the printer in the embodiment.

Next, the electrical structure of the printer 1 will be described with reference to FIG. 2. In addition to the sheet feed unit 10, image forming unit 20, fixing unit 60, and the like illustrated in FIG. 1, the printer 1 includes a control unit 100, a manipulation display unit 111, a motor control circuit 112, a clutch control circuit 113, and the like. The control unit 100 includes a central processing unit (CPU) 101, a random-access memory (RAM) 102, a read-only memory (ROM) 103, an application-specific integrated circuit (ASIC) 104, and the like. The CPU 101 execute various types of programs including detection processing and reverse processing, which will be described later, the programs being stored in the ROM 103, to control the sheet feed unit 10, image forming unit 20, fixing unit 60, manipulation display unit 111, and the like, which are mutually connected through a bus 105. The RAM 102 is used as the main storage device with which the CPU 101 executes various types of processing. Control programs and various types of data are stored in the ROM 103. The ASIC 104 is notified of the rotational speed of the motor M1 by the CPU 101, calculates a duty cycle of a pulse width modulation (PWM) signal according to the rotational signal, and outputs the duty cycle to the motor control circuit 112. The manipulation display unit 111 includes various types of buttons, including a power supply button, and also includes a touch panel and the like. The manipulation display unit 111 displays a setting screen used for printing and other purposes, the operation state of the printer 1, and the like. The manipulation display unit 111 also accepts settings for, for example, printing.

The motor control circuit 112 controls the supply of a DC driving voltage to the motor M1 (see FIG. 1) to control the motor M1. The motor control circuit 112 also outputs a Hall signal and a frequency generator (FG) signal, which will be described later, to the control unit 100 as will be described later in detail. The clutch control circuit 113 controls the supply of control signals, such as DC voltages, to the electromagnetic clutches 86, 82, 93, and 96 to control the electromagnetic clutches 86, 82, 93, and 96. For example, the electromagnetic clutches 86, 82, 93, and 96 may be placed in transmission and disconnected states (further described below) based on receiving first and second control signals, respectively. The sensor Se is used to collectively refer to the back-end sensors Se1 to Se4, pre-registration sensor Se5, first post-registration sensor Se6, and second post-registration sensor Se7 illustrated in FIG. 1. The sensor Se outputs an ON or OFF signal to the control unit 100 depending on whether a sheet P is present, as described above.

Next, the motor M1 and motor control circuit 112 will be described in detail.

The motor M1 is, for example, a DC brushless motor of three phases, U, V, and W. The motor M1 includes a stator in which a U-phase coil, a V-phase coil, and a W-phase coil are disposed so as to be star-connected at an intermediate point, a rotor, Hall elements, a frequency generator, and the like. The rotor, which is disposed around the stator, includes alternately disposed N-pole magnets and S-pole magnets. A total of three Hall elements, for example, are disposed in the vicinity of the rotor so as to be equally spaced at 120-degree intervals. Each Hall element detects a rotational phase of the rotor according to a magnetic field, which changes with the rotation of the rotor. The frequency generator generates an FG signal, which has a frequency proportional to the rotational speed of the rotor.

The motor control circuit 112 includes an inverter 112*a* and is electrically connected to the Hall elements and frequency generator included in the motor M1. The motor control circuit 112 uses signals output from the Hall elements to acquire a Hall signal, which is a pulse signal related to the number of poles of the rotor, and outputs the Hall signal to the control unit 100. The motor control circuit 112 also acquires an FG signal from the frequency generator and outputs the FG signal to the control unit 100.

The motor control circuit 112 controls current to each coil included in the motor M1 under PWM control and drives the motor M1. The inverter 112*a* included in the motor control circuit 112 is connected to the coils in the motor M1. The inverter 112*a* includes three switch circuits. Each switch circuit is comprised of two transistors, which are connected in series between a power supply voltage and a ground voltage. The point at which the two transistors are connected is connected to an end of the relevant coil. The transistor is implemented by using, for example, a bipolar transistor or a metal oxide semiconductor field-effect transistor (MOSFET). The motor control circuit 112 inputs a PWM signal to the gate terminal or base terminal of each transistor in correspondence to the terminal. Each transistor is turned on while, for example, the PWM signal is turned on. For example, the motor control circuit 112 outputs a PWM signal that commands current to a transistor included in the switch circuit connected to the U-phase coil, the transistor being connected to the power supply voltage, and to a transistor included in the switch circuit connected to the W-phase coil, the transistor being connected to the ground voltage. Thus, a current flows from the U-phase coil to the V-phase coil, in which case, for example, the U-phase coil is excited to the N pole and the V-phase coil is excited to the S pole. As a result, the rotor rotates. The larger the duty cycle of the PWM signal is, the higher the rotational speed is. As described above, when the CPU 101 notifies the ASIC 104 of a target rotational speed, the ASIC 104 calculates the duty cycle of the PWM signal at which the target rotational speed is attained and outputs the duty cycle to the motor control circuit 112. The motor control circuit 112 accepts the duty cycle and outputs a PWM signal at the duty cycle to the motor M1. The ASIC 104 compares the Hall signal or FG signal fed back from the motor control circuit 112 with the target rotational speed to adjust the duty cycle of the PWM signal. Thus, the control unit 100 can control the motor M1 to the target rotational speed.

If the conveying route R is blocked with a sheet P while being conveyed during an image forming operation, a so-called jam may occur. The control unit 100 can decide whether a jam has occurred, according to a signal output from a sensor Se. If, for example, a sheet P that has passed the pre-registration sensor Se5 reaches the first post-registration sensor Se6, after a predetermined time has elapsed, the control unit 100 can decide that the sheet P has not jammed. The printer 1 includes three optional sheet feed units 70 as described above. The conveying route R from the tray T4 of the lowest optional sheet feed unit 70 to the image forming unit 20 is longer than the conveying route R from the tray T1 to the image forming unit 20. However, no sensor is attached to the conveying route R from the rear-edge sensor Se4 attached to the tray T4 to the pre-registration sensor Se5. Therefore, if a decision is made based on only a signal from a sensor, when a jam occurs in the conveying route R from the tray T4 to the image forming unit 20, there has been a risk that detection of the jam will be delayed. If the control unit 100 decides that a jam has occurred, the control unit 100 suspends the image forming operation. At the same time, the control unit 100 causes the manipulation display unit 111 to display an error message to prompt the user to remove the jammed sheet P. If the image forming operation is continued without the jammed sheet P being removed, a subsequent sheet P is conveyed to the location at which the jam has occurred. This may worsen the jam. If the jam is worsened, it becomes difficult for the user to remove the jammed sheets P. In jam detection processing described later, therefore, a jam is detected according to an increase in the load of the motor M1. If a jam occurs, the load of the motor M1 is increased because, for example, the jammed sheet P impedes the rotation of conveying rollers. An increase in the load of the motor M1 at the occurrence of a jam will be described below in detail.

It is also possible to detect the magnitude of the load of the motor M1 by, for example, measuring a current flowing in the motor M1. However, a case in which the magnitude of the load is detected according to the duty cycle of the PWM signal will be described here. The duty cycle of the PWM signal reflects the magnitude of the load of the motor M1. If a jam occurs, the rotation of the conveying rollers at the position of the jam is impeded, so the torque of the motor M1 is increased. Unless the current that is to flow into the motor M1 is increased, the target rotational speed cannot be maintained. In view of this situation, the ASIC 104 increases the duty cycle of the PWM signal. Therefore, if the duty cycle of the PWM signal is large, the control unit 100 can decide that the load of the motor M1 is large. In this arrangement, even if the printer 1 is not structured to detect the value of the current flowing in the motor M1, the control unit 100 can measure the magnitude of the load of the motor M1 by acquiring the duty cycle of the PWM signal, the duty cycle being calculated by the ASIC 104.

Figure 3:
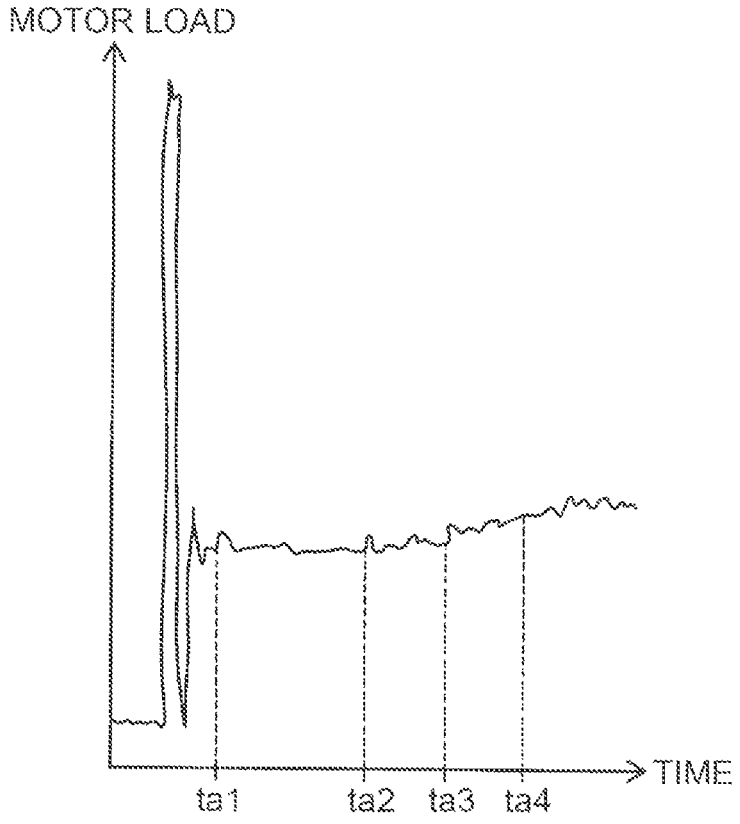
FIG. 3 illustrates how a motor load changes when a small sheet becomes jammed.
Figure 4:
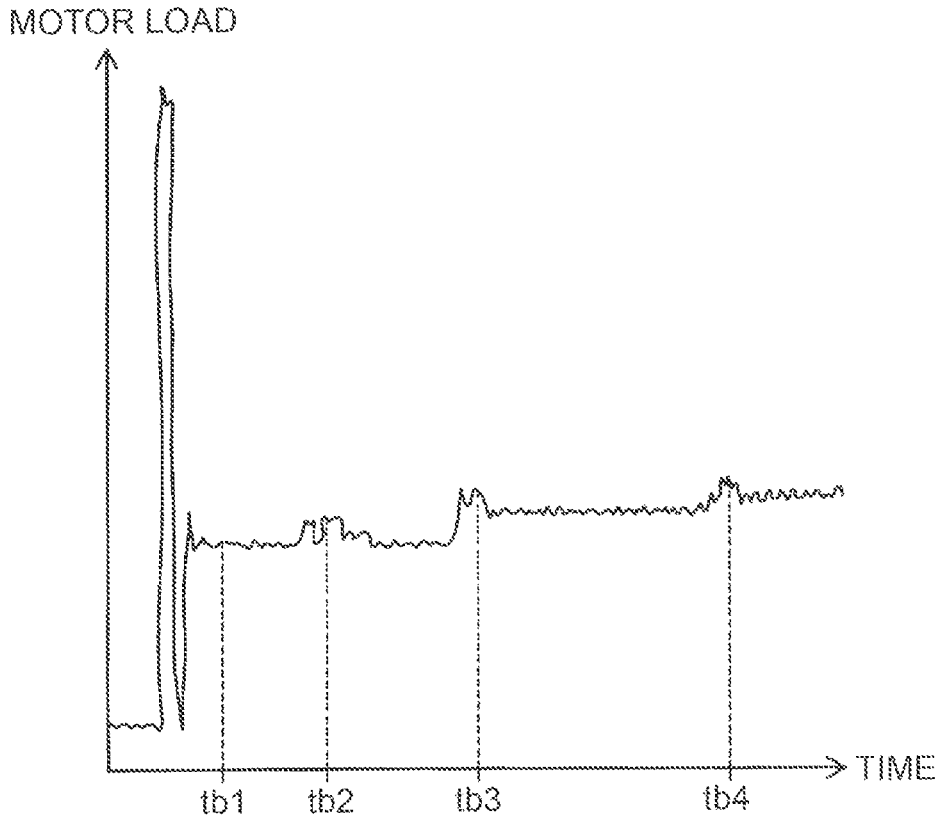
FIG. 4 illustrates how a motor load changes when a large sheet becomes jammed.

FIGS. 3 and 4 illustrate results of experiments in which the conveying route R was blocked in the vicinity of the pre-registration sensor Se5 to reproduce a jam and variations in the load of the motor M1 were investigated. Sheets P in different sizes were used in the experiments in FIGS. 3 and 4; the size of the sheet P in FIG. 3 is smaller than in FIG. 4. The feed tray used in image forming was the tray T4 and successive printing was performed on three sheets P.

In FIGS. 3 and 4, the horizontal axis indicates elapsed time and the vertical axis indicates the motor load. Here, the magnitude of the duty cycle of the PWM signal corresponds to the magnitude of the load of the motor M1. After the printer 1 had been turned on, the control unit 100 caused the motor M1 to start. The large peaks in FIGS. 3 and 4 were due to the start of rotation of the motor M1. Times ta1, ta2, and ta4 in FIG. 3 respectively indicate times at which a first sheet P, a second sheet P, and a third sheet P were supplied. Time ta3 is a time at which the electromagnetic clutch 86 that switches the transmission of the driving force to the developing roller 33 was turned on. The load was temporarily increased around time ta3, and the load was gradually increased around time ta3 and later. Times tb1, tb3, and tb4 in FIG. 4 respectively indicate times at which a first sheet P, a second sheet P, and a third sheet P were supplied. Time tb2 is a time at which the electromagnetic clutch 86 was turned on. The load was increased around time tb2. In FIG. 4, the load was increased at time tb3 in a stepped manner.

Figure 5:
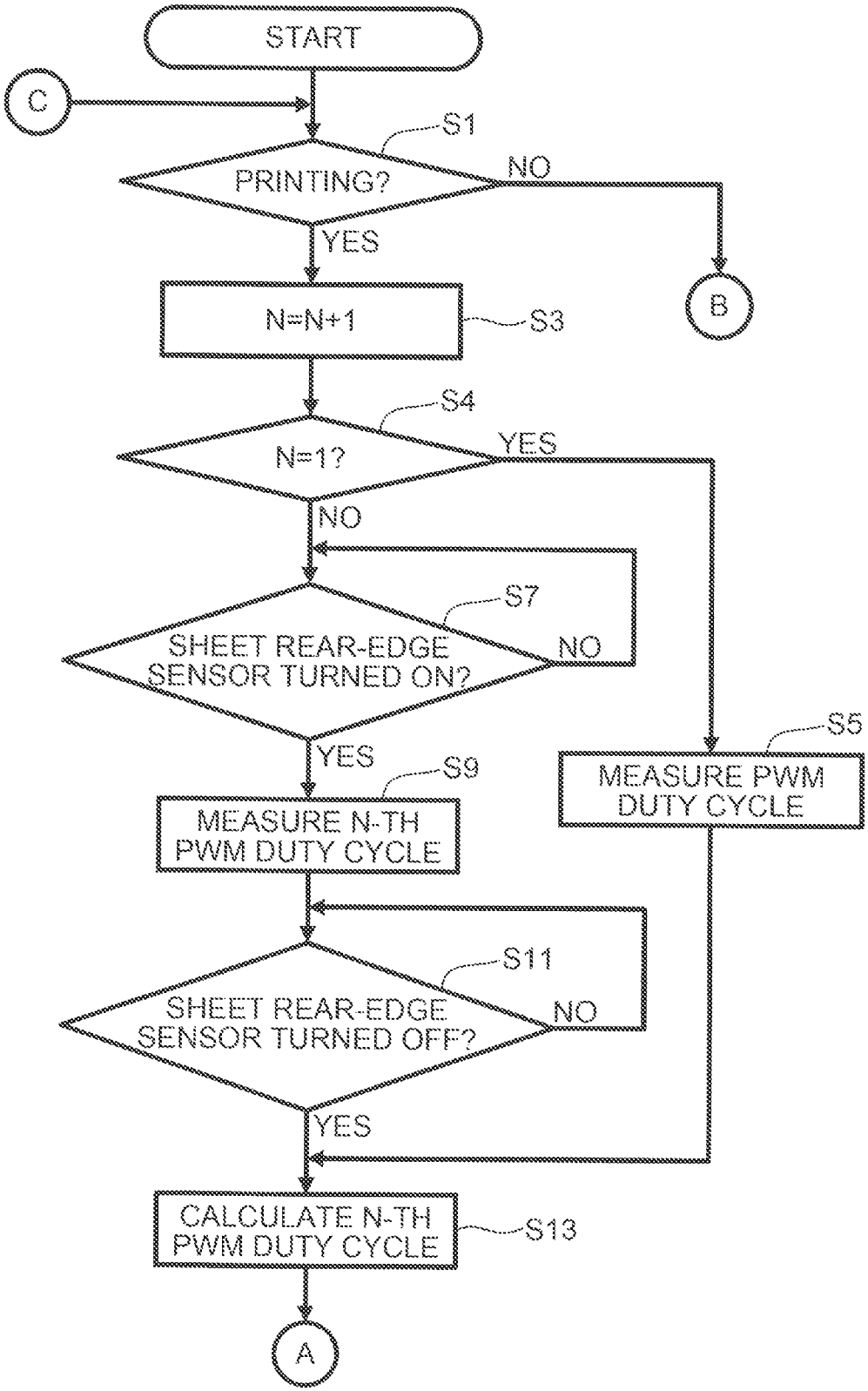
FIG. 5 is the first part of a two-part flowchart illustrating detection processing.
Figure 6:
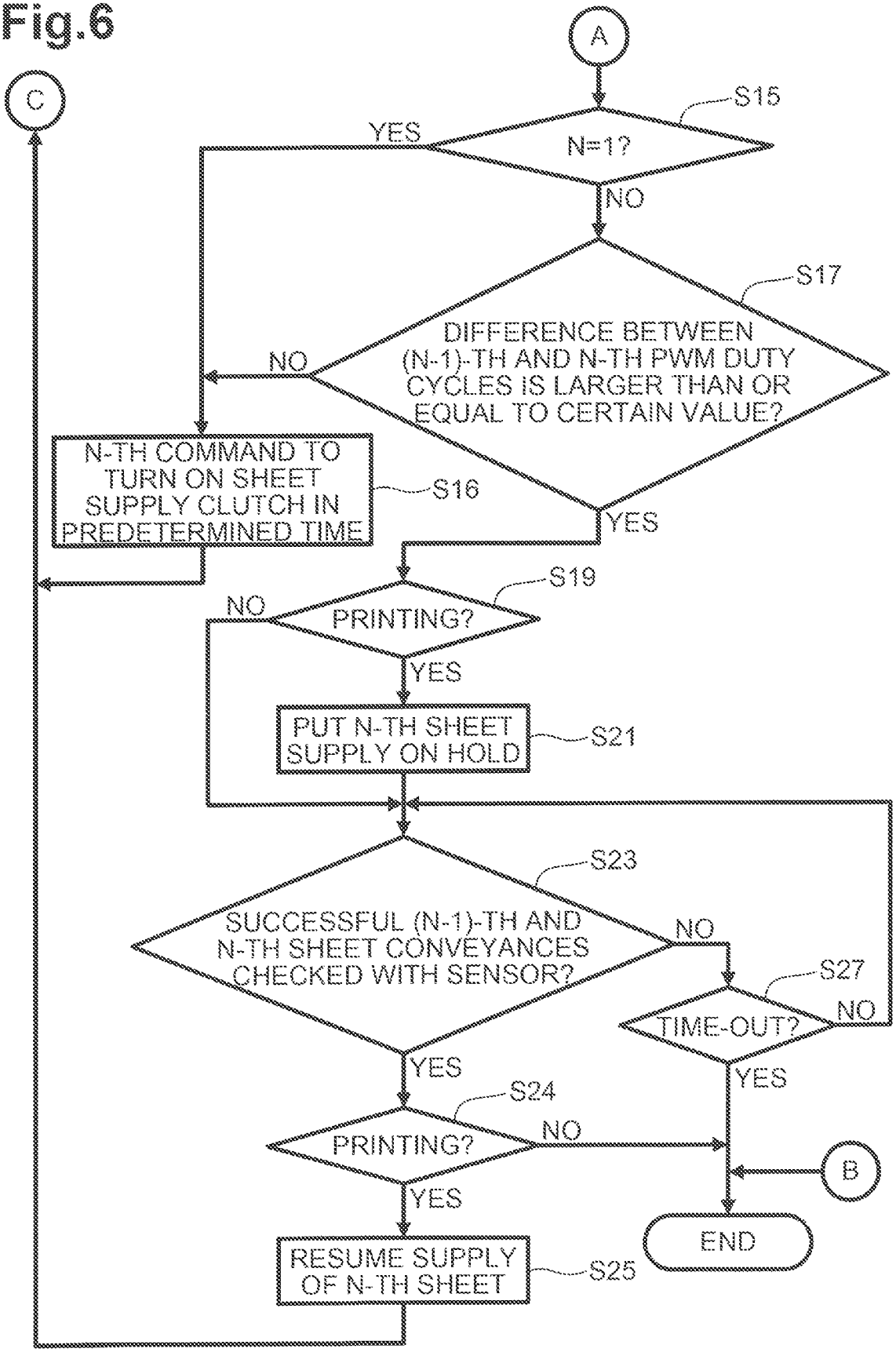
FIG. 6 is the second part of the flowchart illustrating detection processing.

Comparing FIG. 3 and FIG. 4, the load was increased in response to a sheet supply at different times. This is because the size of the sheet P differed. When the size of the sheet P was small (see FIG. 3), the supply of the second sheet P was already complete before the first sheet P reached the vicinity of the pre-registration sensor Se5 at which the conveying route R was blocked and an increase in load was started. By comparison, when the size of the sheet P was large (see FIG. 4), the time at which an increase in load was started and the time of the supply of the second sheet P were almost the same. In FIGS. 3 and 4, although a tendency for the load to increase differs due to, for example, a difference in the size of the sheet P, the phenomena in which the loads are increased are the same, so the inventors found that variations in the load can be used to detect a jam. Detection processing to detect a jam will be described below with reference to FIGS. 5 and 6.

When the printer 1 is turned on, it enters a standby state in which the printer 1 waits for a print job. The control unit 100 commands the motor control circuit 112 to place the motor M1 in an operation state. Then, the motor M1 enters the operation state. The control unit 100 also commands the clutch control circuit 113 to place the electromagnetic clutches 96 in the trays T2 to T4 in the transmission state in which the electromagnetic clutches 96 can transmit the driving force. Thus, the electromagnetic clutches 96 in the trays T2 to T4 enter the transmission state, and the driving force of the motor M1 is transmitted to the conveying rollers 74 in the trays T2 to T4, causing the conveying rollers 74 in the trays T2 to T4 to start rotating.

Upon receipt of a print job, the control unit 100 sets to 0 a count N to be stored in the RAM 102 and starts detection processing. In an example described here, it will be assumed that the number of copies to be printed is 3, a print job specifying the tray T4 as the feed tray is accepted, three sheets P are printed in succession, and the load of the motor M1 is increased after a second sheet P is supplied.

First, the control unit 100 decides whether to perform printing (S1). Printing as described here indicates processing to supply one sheet P and form an image on it. If the control unit 100 decides to perform printing (the result in S1 is Yes), the control unit 100 increments the count N (S3) to 1. The control unit 100 then decides whether the count N is 1 (S4). Since the count N is 1, the control unit 100 decides that the count N is 1 (the result in S4 is Yes) and measures a PWM duty cycle (S5). To measure a PWM duty cycle is to acquire, in a predetermined period, the duty cycle of the PWM signal, the duty cycle having been calculated by the ASIC 104 described above. Since the ASIC 104 calculates the duty cycle of the PWM signal a plurality of times in the predetermined period, a plurality of duty cycles are obtained. Next, the control unit 100 calculates a first PWM duty cycle (S13). Specifically, the control unit 100 calculates the average of the plurality of duty cycles of PWM signals that have been obtained in step S5. If, for example, the electromagnetic clutch 86, which transmits the driving force to the developing roller 33, is turned on, the reason for an increase in the load of the motor M1 is clear, so the period in which the load is increased is excluded from the calculation. A calculation method in this case will be described later. Next, the control unit 100 decides whether the count N is 1 (S15). Since the count N is 1, the control unit 100 decides that the count N is 1 (the result in S15 is Yes) and issues a first ON command to the clutch control circuit 113 to have it place the electromagnetic clutch 93 included in the tray T4 in the transmission state to start to supply a first sheet P (S16). Thus, the clutch control circuit 113 places the electromagnetic clutch 93 included in the tray T4 in the transmission state for a predetermined period. The control unit 100 then returns to step S1 to supply a second sheet P.

Figure 7:
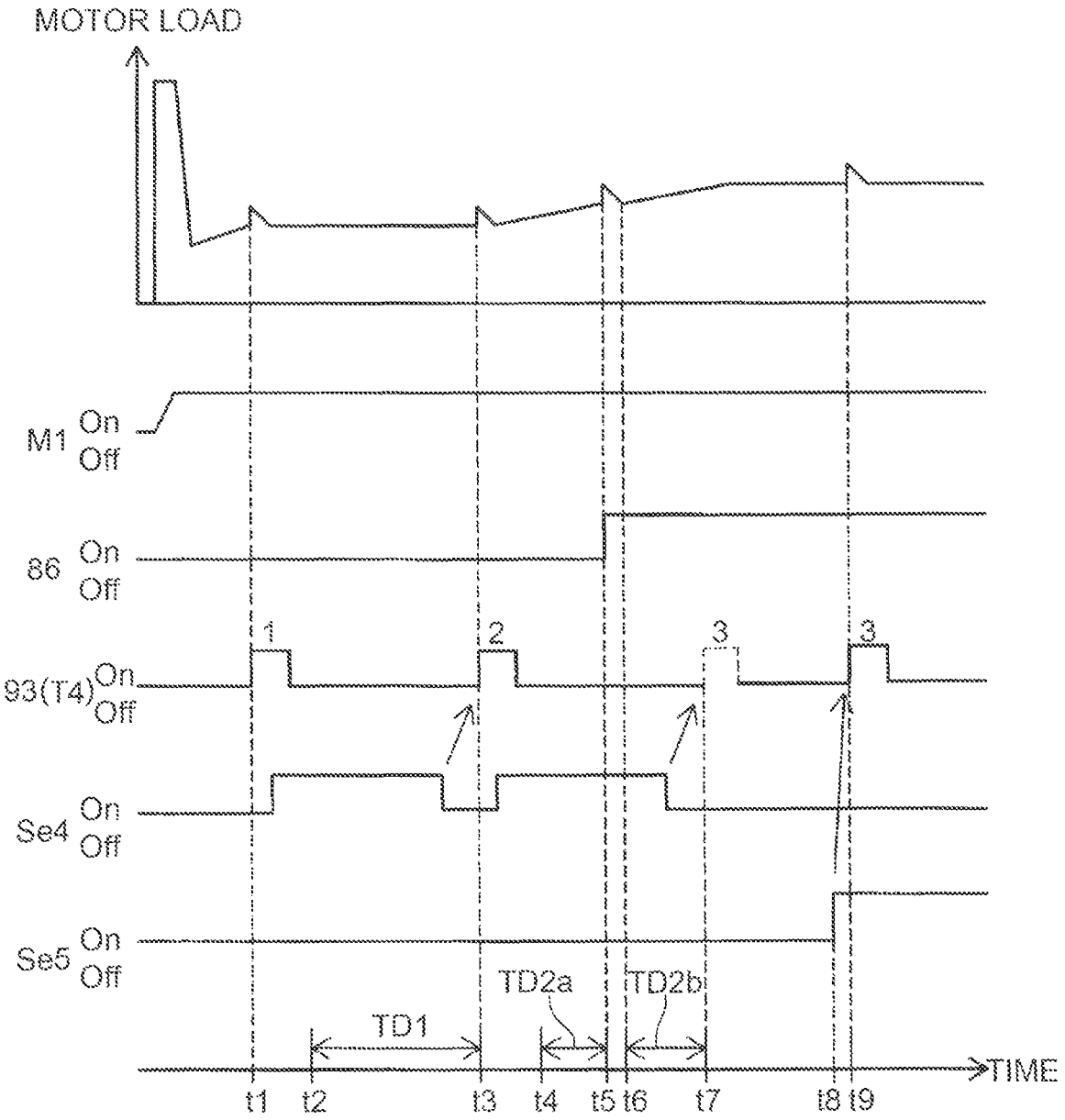
FIG. 7 is a timing diagram illustrating correspondence between the motor load and detection processing steps.

The steps described so far will be described with reference to FIG. 7. In FIG. 7, the motor load indicates the magnitude of the load of the motor M1, and M1, 86, and 93 (T4) respectively indicate the operation states of the motor M1, the electromagnetic clutch 86, and the electromagnetic clutch 93 in the tray T4. Se4 indicates a signal output from the rear-edge sensor Se4, and Se5 indicates a signal output from the pre-registration sensor Se5.

When the printer 1 is turned on, the motor M1 is turned on and start rotating in response to a command from the control unit 100. A first peak of the motor load is caused by the start of the rotation of the motor M1. Then, the electromagnetic clutches 96 included in the trays T2 to T4 are placed in the transmission state in response to a command from the control unit 100. Specifically, the control unit 100 commands the trays T2 to T4 so that the electromagnetic clutches 96 included in them are sequentially placed in the transmission state, starting from the top tray, that is, the tray T2 followed by the trays T3 and T4 in that order. Accordingly, the motor load is gradually increased. When the control unit 100 starts detection processing, if the control unit 100 decides that there is printing processing to be performed (the result in S1 is Yes), the control unit 100 obtains the duty cycles of PWM signals in a predetermined period taken before the first sheet P is supplied (S5) and calculates the average of the duty cycles (S13). The control unit 100 then supplies a first sheet P at time t1 (S16).

The description of the flowchart will be continued with reference again to FIG. 5. Since the printing of a second sheet P is to be performed, the control unit 100 decides that there is printing processing to be performed (the result in S1 is Yes) and increments the count N to 2 (S3). Since the count N is 2, the control unit 100 decides that the count N is not 1 (the result in S4 is No) and decides whether the rear-edge sensor Se4 in the tray T4, which is a feed tray, has been turned on (S7). If the control unit 100 decides that the rear-edge sensor Se4 has not been turned on (the result in S7 is No), the control unit 100 waits until the rear-edge sensor Se4 is turned on. If the control unit 100 decides that rear-edge sensor Se4 has been turned on (the result in S7 is Yes), the control unit 100 starts a second PWM duty cycle measurement (S9). The control unit 100 then decides whether the rear-edge sensor Se4 has been turned off (S11). If the control unit 100 decides that the rear-edge sensor Se4 has not been turned off (the result in S11 is No), the control unit 100 waits until the rear-edge sensor Se4 is turned off. If the control unit 100 decides that rear-edge sensor Se4 has been turned off (the result in S11 is Yes), the control unit 100 terminates the second PWM duty cycle measurement, calculates a second PWM duty cycle, and stores the calculated duty cycle in the RAM 102 (S13).

Since the count N is 2, the control unit 100 decides that the count N is not 1 (the result in S15 is No) and decides whether a difference between the first and second PWM duty cycles is equal to or larger than a certain value (S17). Specifically, the control unit 100 decides whether a difference in the averages of duty cycles, which is obtained by subtracting the average of the first PWM duty cycles from the average of the second PWM duty cycles, is equal to or larger than a reference value stored in the ROM 103. If the control unit 100 decides that the difference between the averages of the first and second duty cycles is smaller than the reference value (the result in S17 is No), the control unit 100 decides that the load of the motor M1 has not been increased and there is no jam. To supply a second sheet P, the control unit 100 then issues a second ON command to the clutch control circuit 113 to have it place the electromagnetic clutch 93 in the transmission state (S16), after which the control unit 100 returns to step S1.

The control unit 100 sets the count N to 3 and executes steps S1 to S4 and S7 to S17 in the same way as described above. If the control unit 100 decides, in step S17, that a value obtained by subtracting the second PWM duty cycle from a third PWM duty cycle is equal to or larger than a reference value (the result in S17 is Yes), the control unit 100 decides that the load of the motor M1 has been increased and there may be a jam and then proceeds to step S19. In step S19, the control unit 100 decides whether there is printing processing to be performed. Since there is printing processing to be performed for a third sheet P, the control unit 100 decides that there is printing processing to be performed (the result in S19 is Yes) and then puts the supply of the third sheet P on hold (S21). At that time, the electromagnetic clutch 96, which transmits the driving force to the conveying rollers 74, is kept in the transmission state. Therefore, the first and second sheets P, which have been already supplied, continue to be conveyed. The control unit 100 then decides whether the first and second conveyances of the sheets P have succeeded (S23).

The control unit 100 decides, according to a signal output from the pre-registration sensor Se5, whether a sheet P has been successfully conveyed. The control unit 100 executes conveyance confirmation processing to decide, according to a signal output from the pre-registration sensor Se5, whether a sheet P has been successfully conveyed, separately from detection processing. In conveyance confirmation processing, the control unit 100 uses the rear-edge sensor Se4 in the tray T4 specified as the feed tray to count a time elapsed after the rear edge of the sheet P has passed the rear-edge sensor Se4. The control unit 100 can calculate a conveyance time taken from when the rear edge of the sheet P has passed the rear-edge sensor Se4 until the front edge of the sheet P reaches the pre-registration sensor Se5, according to the size of the sheet P and a conveyance speed stored in, for example, the ROM 103. Therefore, even after the conveyance time is elapsed after the rear edge of the sheet P has passed the rear-edge sensor Se4, if the signal from the pre-registration sensor Se5 is not changed to an ON signal in response to the arrival of the front edge of the sheet P, the control unit 100 decides that the conveyance has failed and a jam has occurred. If the signal from the pre-registration sensor Se5 is changed to an ON signal in response to the arrival of the front edge of the sheet P, the control unit 100 decides that the conveyance has succeeded.

In step S23, the control unit 100 produces a Yes result if the control unit 100 decides that the sheet P has been successfully conveyed in conveyance conformation processing, and produces a No result if the control unit 100 decides that the sheet P has been unsuccessfully conveyed in conveyance conformation processing. If the control unit 100 decides that the sheet P has been successfully conveyed (the result in S23 is Yes), the control unit 100 resumes the supply of the third sheet P (S25) and returns to step S1. Since the number of copies to be printed is 3, the control unit 100 decides that there is no more printing processing to be performed (the result in S1 is No) and terminate the processing.

The steps described so far will be described with reference to FIG. 7. After the first sheet P has been supplied at time t1, the rear-edge sensor Se4 is turned on while the first sheet P is passing it. The control unit 100 acquires duty cycles of the PWM signals in a period TD1 taken before the second sheet P is supplied (S5) and calculates the average of the duty cycles (S13). To eliminate an increase in the load due to a switchover of the electromagnetic clutch 93 to the transmission state, duty cycles in a predetermined time measured from time t1 are excluded. If the control unit 100 decides that there is no increase in the load of the motor M1 (the result in S17 is No), the control unit 100 issues a second On command for the electromagnetic clutch 93 at time t3, which is a time after the elapse of a predetermined time after the first sheet P has passed the rear-edge sensor Se4 and it has been turned off (S16). Thus, the second sheet P is supplied. As with the first sheet P, after the second sheet P has been supplied, the rear-edge sensor Se4 is turned on while the second sheet P is passing it. Then, the control unit 100 acquires the duty cycles of PWM signals in the period TD1 taken before the second sheet P is supplied (S9). Although not illustrated, a period from time t4 to time t7 is the same as the period TD1. In an example described here, the electromagnetic clutch 86, which transmits the driving force to the developing roller 33, is turned on at time t5 and is switched to the transmission state. As described with reference to FIGS. 3 and 4, when the electromagnetic clutch 86 is turned on, the load of the motor M1 is increased. Therefore, the average is calculated by excluding a period from time t5 to time t6 during which the load is increased because the electromagnetic clutch 86 has been turned on (S13). Specifically, the average of the duty cycles of PWM signals output in a period TD2*a* from time t4 to t5 and a period TD2*b* from time t6 to time t7 is calculated. As a method of excluding a period, a predetermined period starting from when the electromagnetic clutch 86 is turned on is excluded. If the control unit 100 decides that a difference obtained by subtracting the second PWM duty cycle from the third PWM duty cycle is equal to or larger than a reference value (the result in S17 is Yes), the control unit 100 puts a third ON command for the electromagnetic clutch 93 on hold (S21); the third ON command is intended to be output at time t7, which is a time after the elapse of a predetermined time after the rear-edge sensor Se4 has been turned off, if the control unit 100 decides that the difference is smaller than the reference value (the result in S17 is No). If the pre-registration sensor Se5 is turned on at time t8, the control unit 100 decides that the conveyance has succeeded and the first and second sheets P have arrived at the pre-registration sensor Se5 (S23) and resumes the third ON command for the electromagnetic clutch 93, which has been put on hold, at time t9 (S25).

The description of the flowchart will be continued with reference again to FIG. 6. If the control unit 100 decides that the sheet P has been unsuccessfully conveyed (the result in S23 is No), the control unit 100 decides whether a time-out has occurred (S27). Specifically, until a predetermined time elapses, the control unit 100 decides that a time-out has not occurred (the result in S27 is No), in which case the control unit 100 returns to step S23. If the predetermined time has elapsed and the control unit 100 decides that a time-out has occurred (the result in S27 is Yes), the control unit 100 terminates the processing. As a structure in which, if the control unit 100 produces a No result in step S23 and produces a Yes result in step S27, the control unit 100 changes the value of a flag, which indicates the occurrence of a jam, stored in, for example, in the RAM 102, the control unit 100 displays an error message on the manipulation display unit 111 according to the value of the flag.

In detection processing, if the control unit 100 decides that the load of the motor M1 has been increased, the control unit 100 puts the sheet supply on hold. If a first or second sheet P becomes jammed but a third sheet P is supplied, the number of jammed sheets P is increased, which may worsen the jam. When the supply of the third sheet P is put on hold, it is possible to suppress the jam from worsening. However, the reason of an increase in the load may not be a jam. In view of this, the first and second sheets P continue to be conveyed. This prevents a throughput in image forming from being lowered. Whether the first or second sheet P becomes jammed can be reliably checked with a signal from the pre-registration sensor Se5. If the control unit 100 confirmed that neither the first nor second sheet P becomes jammed, the control unit 100 resumes the supply of the third sheet P.

Now, a variation of detection processing will be described. Although, in the above description, the electromagnetic clutch 96, which transmits the driving force to the conveying rollers 74, has been maintained in the transmission state in step S21, the conveyance of the second sheet P located upstream of the first sheet P may be put on hold. If the first sheet P has jammed, this suppresses the second sheet P from being conveyed to a position of the jam and thereby suppresses the conveying route R from being blocked. Specifically, the control unit 100 uses the rear-edge sensor Se4 to count a time elapsed after the edge of the sheet P on the upstream side has passed the rear-edge sensor Se4. The control unit 100 can identify the position of the sheet P in the conveying route R from a time elapsed after the edge of the sheet P on the upstream side has passed the rear-edge sensor Se4 until the control unit 100 executes step 21 and from the conveyance speed stored in, for example, the ROM 103. The rotation of the conveying rollers located upstream of the identified position of the sheet P is put on hold. This suppresses the jam from worsening.

Figure 8:
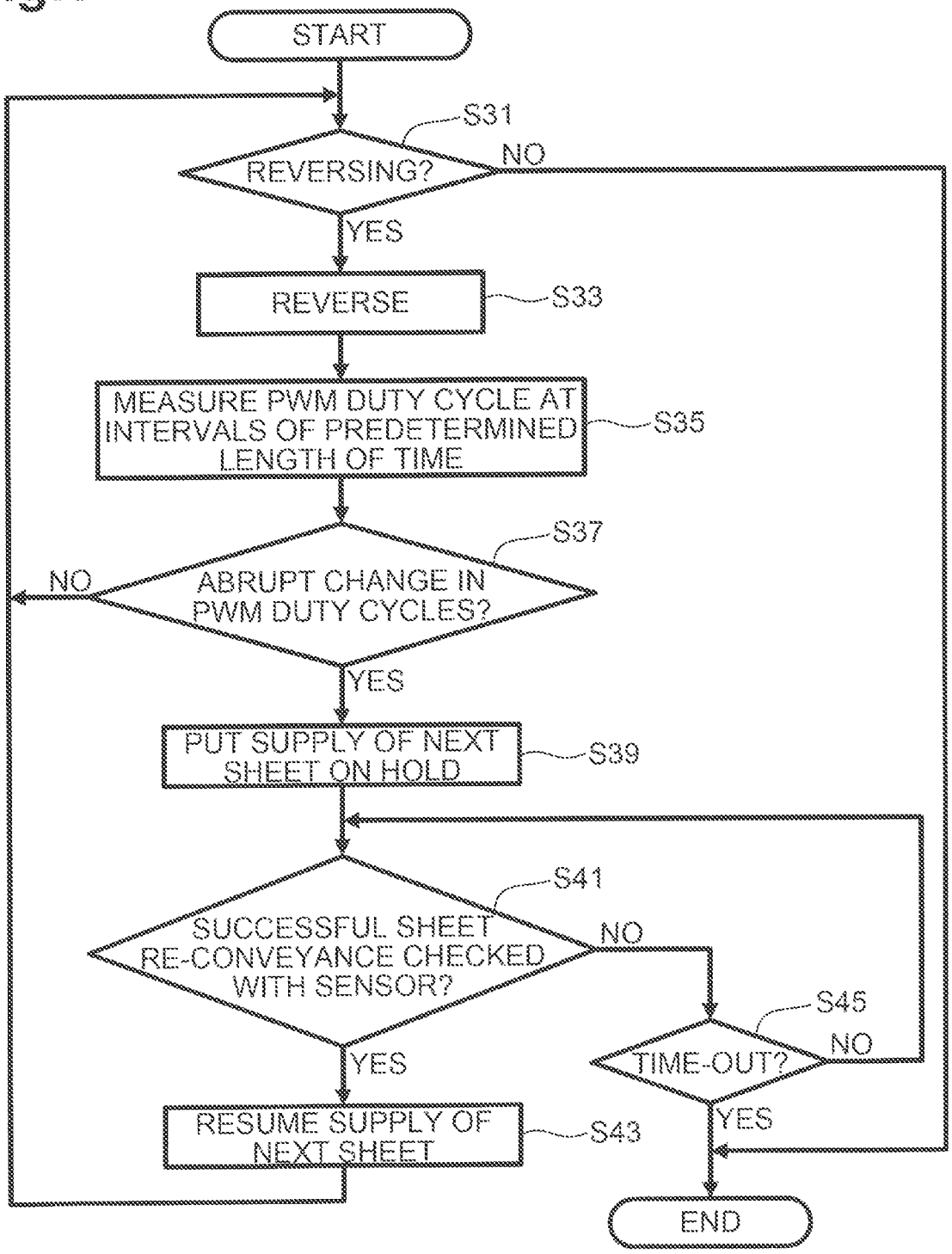
FIG. 8 is a flowchart illustrating reverse processing.

Next, reverse processing will be described with reference to FIG. 8.

Upon receipt of a print job, the control unit 100 starts reverse processing. The control unit 100 then decides whether reversing is specified (S31). If two-sided printing is included in the print job, the control unit 100 decides that reversing is specified. If the control unit 100 decides that reversing is specified (the result in S31 is Yes), the control unit 100 starts reversing (S33). Specifically, the control unit 100 controls the relevant conveying rollers and starts processing involved in two-sided printing. The control unit 100 then measures the PWM duty cycle at intervals of a predetermined length of time (S35). In reverse processing, a conveyance time taken to convey a sheet P from the branching point A on the re-conveying route Ra to the joining point B is preset. Therefore, the conveyance is divided by a predetermined division number to obtain the predetermined time. Then, the control unit 100 decides whether there is an abrupt change in the measured PWM duty cycles (S37). Specifically, a duty cycle is obtained at intervals of the predetermined length of time, calculates an average, and calculates a difference between two segments, as in detection processing. If the difference is equal to or larger than a predetermined value, the control unit 100 decides that there is an abrupt change (the result in S37 is Yes). If the control unit 100 decides that there is an abrupt change (the result in S37 is Yes), the control unit 100 puts the supply of a next sheet from the feed tray on hold (S39). The control unit 100 then checks whether the sheet P that was being re-conveyed has been successfully re-conveyed (S41). Specifically, after the elapse of a predetermined time after it was checked with the second post-registration sensor Se7 that the rear edge of the sheet P passed the second post-registration sensor Se7, if the presence of the sheet P is checked with the pre-registration sensor Se5, the control unit 100 decides that the sheet P has been successfully re-conveyed. If the control unit 100 decides that the sheet P has been successfully re-conveyed (the result in S41 is Yes), the control unit 100 resumes the supply of the sheet P, which has been put on hold (S43), and returns to step S31. If the control unit 100 decides that there is no abrupt change (the result in S37 is No), the control unit 100 decides that no jam has occurred and returns to step S31. If the control unit 100 decides that the sheet P has not been successfully re-conveyed (the result in S41 is No), the control unit 100 decides whether a time-out has occurred (S45). Specifically, until a predetermined time elapses, the control unit 100 decides that a time-out has not occurred (the result in S45 is No), in which case the control unit 100 returns to step S41. If the predetermined time has elapsed and the control unit 100 decides that a time-out has occurred (the result in S45 is Yes), the control unit 100 terminates the processing.

The control unit 100 is an example of a control apparatus. The feed tray 11 and optional feed tray 71 are an example of a tray. The conveying route R is an example of a conveying route. The supply roller 13 and optional supply roller 73 are an example of a first roller. The conveying rollers 14, 15, 16, and 74 are an example of a second roller. The pre-registration sensor Se5 is an example of a sensor. Steps S5 and S9 in detection processing are an example of acquisition processing. Steps S17 in detection processing is an example of decision processing. Step S21 in detection processing is an example of continuation processing and first on-hold processing. Step S25 in detection processing is an example of resumption processing. The back-end sensors Se1 to Se4 are an example of a passage sensor. The fifth transmitting portion 87 in a state in which the electromagnetic clutch 86 is in the disconnected state is an example of a first transmission route. The fifth transmitting portion 87 in a state in which the electromagnetic clutch 86 is in the transmission state is an example of a second transmission route. The electromagnetic clutch 86 is an example of a developing electromagnetic clutch. The Hall signal and FG signal are an example of a rotation signal. The re-conveying route Ra is an example of a sheet conveying route. Step S39 in reverse processing is an example of second on-hold processing. The PWM signal is an example of a PWM control signal. The first sheet P is an example of a second sheet and a fourth sheet. The second sheet P is an example of a third sheet. The third sheet P is an example of a first sheet.

The embodiment described above has the following effects.

If the control unit 100 decides in step S17 that the load of the motor M1 has been increased, a jam may have occurred. Therefore, the feeding of an Nth sheet from the feed tray is put on hold in step S21, so it possible to suppress the jam from worsening. Since (N−1)th and Nth conveyances are continued, image forming on (N−1)th and Nth sheets P can be continued, so it is possible to suppress a throughput in image forming from being lowered. Since the control unit 100 can resume the conveyance of the (N−1)th sheet P, which has been put on hold in step S25, it is possible to suppress the throughput in image forming from being lowered. Since the average of duty cycles is calculated in step S13 and calculated averages are compared in step S17, effects due to variations in the magnitude of the load can be reduced and the control unit 100 thereby can accurately determine an increase in the load. In the calculation of the average in step S13, an increase in the load is excluded that is caused by a switchover of the electromagnetic clutch 93, which transmits the driving force to the optional supply roller 73, to the transmission state and by a switchover of the electromagnetic clutch 86, which transmits the driving force to the developing roller 33, to the transmission state. Therefore, precision in the detection of an increase in the load due to a jam is improved, so it is possible to prevent conveyance from being unnecessarily put on hold. If the control unit 100 decides in step S37 that the load of the motor M1 has been increased, a jam may have occurred in the re-conveying route Ra. Therefore, the control unit 100 puts the conveyance of the sheet P on hold in step S39. This can suppress the jam from worsening.

The present invention is not limited to the embodiment described above. It will be appreciated that various improvements and modifications are possible without departing from the intended scope of the present invention.

Although, in the above description, the load of the motor M1 has been determined according to the duty cycle of the PWM signal, this is not a limitation; the load may be determined according to the value of a current flowing in the motor M1. Although, in the above description, the load of the motor M1 has been determined by calculating the average of duty cycles of PWM signals, this is not a limitation; a duty cycle at an arbitrary point in time in the period TD1 may be used or the sum of duty cycles at a plurality of points in time may be calculated.

In step S23, only the Nth conveyance may be checked instead of checking the (N−1)th and Nth conveyances. In this case, the sheet P may be decided to have been successfully conveyed if the state of the pre-registration sensor Se5 is changed from outputting an OFF signal to outputting an ON signal. This decision can be made when the sheet P has not yet reached the pre-registration sensor Se5 during execution in step S23. If the signal from the pre-registration sensor Se5 is changed to an ON signal, the control unit 100 can decide that the sheet P has reached the pre-registration sensor Se5. Alternatively, the sheet P may be decided to have been successfully conveyed if the state of the pre-registration sensor Se5 is changed from outputting an ON signal to outputting an OFF signal. This decision can be made when the sheet P has already reached the pre-registration sensor Se5 during execution in step S23. If the signal from the pre-registration sensor Se5 is changed to an OFF signal, the control unit 100 can decide that the rear edge of the sheet P has passed the pre-registration sensor Se5.

The method of deciding whether conveyance is being normally performed is not limited to the above. For example, this decision may be made on the basis of the magnitude of the load. Specifically, if the magnitude of the load is equal to or smaller than a reference value, it can be decided that conveyance is being normally performed.

Although, in the above description, a predetermined period starting from when the electromagnetic clutch 86 is turned on has been excluded from the calculation of the average of duty cycles of PWM signals in step S13, this is not a limitation. For example, duty cycles may be compared with a reference value, and if a period during which a duty cycle is equal to or larger than the reference value is shorter than a predetermined period, the period may be excluded.

Although, in the above description, the duty cycles of PWM signals have been acquired in a predetermined period taken before the first sheet P is supplied in step S5, this is not a limitation. The duty cycles of PWM signals may be acquired in a predetermined period that starts after the elapse of a predetermined time after the motor M1 has been turned on.

Although, in this embodiment, the laser printer 1 has been described as an example, this is not a limitation. A so-called multi-function peripheral, which includes a scanner function, a copy function, a facsimile function, and the like, may be used. Further, the laser printing components comprising the image forming unit are also described as an example. In other embodiments, the image forming unit could employ other printing technologies, such as ink jet printing.

Although, in this embodiment, a case in which the control unit 100 includes the CPU 101 and ASIC 104 has been described as an example, this is not a limitation. The control unit 100 may include a plurality of CPUs or may include a plurality of ASICs. Alternatively, the control unit 100 may be an arbitrary combination of CPUs and ASICs.

What is claimed is:

1. A printer, comprising:

a print mechanism;

a tray configured to support a sheet stack including one or more sheets;

a conveying route extending from the tray to the print mechanism;

a first roller disposed adjacent the tray and configured to feed a plurality of sheets in sequence from the tray to the conveying route;

a second roller disposed in the conveying route and configured to convey the plurality of sheets fed by the first roller in sequence to the print mechanism;

a driving source configured to drive the first roller and the second roller; and a controller configured to:

in response to a printing request, apply a driving force from the driving source to the first and second rollers such that the first and second rollers rotate to feed a first sheet from the tray to the conveying route;

in response to a magnitude of a load of the driving source indicating a paper jam, continue to apply the driving force to the second roller such that the second roller rotates to convey the first sheet to the print mechanism, and remove the driving force from the first roller such that the first roller does not rotate so as to not feed a second sheet from the tray to the conveying route; and in response to the first sheet fed from the tray reaching a predetermined first position in the conveying route, reapplying the driving force to the first roller such that the first roller rotates to feed the second sheet from the tray to the conveying route.

2. The printer according to claim 1, wherein the controller is configured to remove the driving force from the first roller so as to stop rotation of the first roller in response to the magnitude of the load of the driving source exceeding a predetermined value.

3. The printer according to claim 2, wherein the controller is configured to continue applying the driving force to the first roller in response to the magnitude of the load of the driving source not exceeding the predetermined value.

4. The printer according to claim 2, wherein the second roller includes an upstream roller and a downstream roller, wherein the controller is configured to remove the driving force from the upstream roller so as to stop rotation of the upstream roller in response to the magnitude of the load of the driving source exceeding the predetermined value.

5. The printer according to claim 4, wherein controller is configured to continue to apply the driving force to the downstream roller in response to the magnitude of the load of the driving force exceeding the predetermined value so as to continue rotation of the downstream roller.

6. The printer according to claim 4, further comprising a second sensor located upstream in the conveying direction of the upstream roller on the conveying route, the second sensor configured to output a third signal when the sheet fed from the tray reaches a predetermined second position in the conveying route and a fourth signal when the sheet fed from the tray has not reached the second position, wherein the controller is configured to remove the driving force from the upstream roller so as to stop rotation of the upstream roller in response to the magnitude of the load of the driving source exceeding the predetermined value over a predetermined time period after the third signal changes to the fourth signal.

7. The printer according to claim 1, further comprising a first sensor located downstream in a conveying direction of the second roller on the conveying route, the first sensor configured to output a first signal when the sheet fed from the tray reaches the first position and a second signal when the sheet fed from the tray has not reached the first position, wherein the controller is configured to:

apply the driving force to the first roller such that the first roller rotates in response to receiving the first signal;

not apply the driving force to the first roller such that the first roller does not rotate in response to receiving the second signal and in response to the magnitude of the load of the driving source exceeding the predetermined value.

8. The printer according to claim 7, further comprising a first electromagnetic clutch having a transmission state in which the first electromagnetic clutch allows the drive force to be transmitted from the driving source to the first roller and a disconnected state in which the first electromagnetic clutch prevents the drive force from being transmitted from the driving source to the first roller, the first electromagnetic clutch configured to be selectively placed in one of the transmission state and the disconnected state, wherein the driving source driving the first and second rollers is a motor, and wherein the controller is configured to control the first electromagnetic clutch to selectively apply the driving force from the motor to the first roller.

9. The printer according to claim 8, wherein the controller is configured to:

cause the first electromagnetic clutch to be placed in the transmission state in response to the printing request;

cause the first electromagnetic clutch to be placed in the disconnected state in response to the magnitude of the load of the motor exceeding the predetermined value; and cause the first electromagnetic clutch to be placed in the transmission state in response to receiving the first signal from the first sensor.

10. The printer according to claim 7, wherein the controller is configured to apply the driving force to the first roller in response to receiving the first signal subsequent to applying the driving force to the second roller, and not applying the driving source to the first roller in response to the magnitude of the load of the driving source exceeding the predetermined value.

11. The printer according to claim 7, wherein the controller is configured to apply the driving force to the first roller in response to receiving the first signal within a predetermined time period.

12. The printer according to claim 11, wherein the controller is configured to remove the driving force from the second roller in response to expiration of the predetermined time period before receiving the first signal such that the second roller stops rotating.

13. The printer according to claim 7, wherein the controller is configured to apply the driving force to the first roller in response to the first signal changing to the second signal subsequent to applying the driving force to the second roller, and not applying the driving force to the first roller in response to the magnitude of the load of the driving source exceeding the predetermined value.

14. The printer according to claim 13, wherein the controller is configured to apply the driving force to the first roller in response to first signal changing to the second signal within a predetermined time period.

15. The printer according to claim 14, the controller is configured to remove the driving force from the second roller in response to expiration of the predetermined time period before the first signal changes to the second signal such that the second roller stops rotating.

16. The printer according to claim 1, wherein the controller is configured to determine the magnitude of the load of the driving source.

17. The printer according to claim 16, wherein the controller is configured to calculate an average of the magnitude of the load of the driving source over a predetermined time period, and in response to the calculated average of the magnitude of a load of the driving source, apply the driving force to the second roller such that the second roller rotates, and not apply the driving force to the first roller such that the first roller does not rotate.

18. The printer according to claim 17, further comprising a first electromagnetic clutch having a transmission state in which the first electromagnetic clutch allows the drive force to be transmitted from the driving source to the first roller and a disconnected state in which the first electromagnetic clutch prevents the drive force from being transmitted from the driving source to the first roller, the first electromagnetic clutch configured to be selectively placed in one of the transmission state and the disconnected state, wherein the driving source driving the first and second rollers is a motor, and wherein the controller is configured to calculate the average of the magnitude of the load of the driving source over the predetermined time period after cause the first electromagnetic clutch to be placed in the transmission state.

19. The printer according to claim 17, further comprising:

a developing roller included in the print mechanism;

a first transmission route configured to allow the developing roller to rotate at a first speed by the drive force from the driving source;

a second transmission route configured to allow the developing roller to rotate at a second speed equal to or larger than the first speed by the drive force;

a second electromagnetic clutch having a first transmission state in which the second electromagnetic clutch allows the drive force to the developing roller via the first transmission route and a second transmission state in which the second electromagnetic clutch allows the drive force to the developing roller via the second transmission route, the clutch configured to be selectively placed in one of the first transmission state and the second transmission state, wherein the controller is configured to calculate the average of the magnitude of the load of the driving source over the predetermined time period after cause the second electromagnetic clutch to be placed in the second transmission state.

20. The printer according to claim 16, wherein determining the magnitude of the load of the driving source includes calculating a duty cycle of a PWM signal applied to the drive source.

21. The printer according to claim 20, wherein the driving source is a DC brushless motor, wherein the controller is configured to:

acquire a signal which is output from the DC brushless motor and corresponds to a rotational speed of the DC brushless motor; and in response to the acquired signal, output the PWM signal at the duty cycle at which the rotational speed approaches a target rotational speed, and the controller measures the duty cycle to determine the magnitude of the load of the driving source.

22. A computer readable storage device including a program that executes a method, comprising:

receiving a printing request;

in response to the received printing request, applying a driving force to a first roller to feed a first sheet from a sheet tray to a conveying route;

in response to the received printing request, applying the driving force to a second roller to convey the first sheet along the conveying route;

determining a magnitude of the driving force; and in response to the determined magnitude of the driving force indicating a paper jam, removing the driving force from the first roller such that the first roller does not rotate so a second sheet is not fed from the sheet tray to the conveying route while continuing to apply the driving force to the second roller to continue to convey the first sheet along the conveying route; and in response to the first sheet fed from the tray reaching a predetermined first position in the conveying route, reapplying the driving force to the first roller such that the first roller rotates to feed the second sheet from the tray to the conveying route.

23. The computer readable storage device of claim 22, wherein if the determined magnitude of the driving force is greater than a predetermined value, removing the driving force from the first roller such that the first roller does not rotate while continuing to apply the driving force to the second roller.

24. The computer readable storage device of claim 22, wherein determining the magnitude of the driving force includes determining a duty cycle of a PWM control signal applied to a motor that provides the driving force.

25. The computer readable storage device of claim 22, wherein determining the magnitude of the driving force includes determining an average of the driving force during a predetermined time period.

26. The computer readable storage device of claim 22, wherein the method further comprises selectively switching outputting control signals to first and second clutches to apply the driving force to the first and second rollers, respectively.

27. The computer readable storage device of claim 22, wherein the second roller includes an upstream roller and a downstream roller; and wherein the method further comprises:

removing the driving source from the upstream roller so as to stop rotation of the upstream roller in response to the magnitude of the driving force exceeding a predetermined value while continuing to apply the driving source to the downstream roller in response to the magnitude of the driving force exceeding the predetermined value so as to continue rotation of the downstream roller.

* * * * *